US010793940B2

(12) United States Patent
Warichet et al.

(10) Patent No.: US 10,793,940 B2
(45) **Date of Patent: *Oct. 6, 2020**

(54) FLUX COMPOSITIONS FOR STEEL GALVANIZATION

(71) Applicant: Fontaine Holdings NV, Houthalen (BE)

(72) Inventors: David Warichet, Wezembeek-Oppem (BE); Julien Balduyck, Bande (BE); Caroline Masquelier, Marcq (BE)

(73) Assignee: FONTAINE HOLDINGS NV, Houthalen (BE)

( * ) Notice: Subject to any disclaimer, the term of this patent is extended or adjusted under 35 U.S.C. 154(b) by 458 days.

This patent is subject to a terminal disclaimer.

(21) Appl. No.: 14/062,170

(22) Filed: Oct. 24, 2013

(65) Prior Publication Data

US 2014/0120367 A1 May 1, 2014

(30) Foreign Application Priority Data

Oct. 25, 2012 (GB) ..... 1219213.4

(51) Int. Cl.
*C23C 2/30* (2006.01)
*C23C 2/02* (2006.01)
*C23C 2/06* (2006.01)

(52) U.S. Cl.
CPC ..... *C23C 2/02* (2013.01); *C23C 2/06* (2013.01); *C23C 2/30* (2013.01); *Y10T 428/12799* (2015.01)

(58) Field of Classification Search
None
See application file for complete search history.

(56) References Cited

U.S. PATENT DOCUMENTS 1,293,823 A * 2/1919 Luckey ..... B23K 35/3612 148/23
2,723,929 A * 11/1955 Wagner ..... B23K 35/3603 148/26
2,801,943 A * 8/1957 Meyer ..... B23K 35/34 148/23
2,817,894 A * 12/1957 Steinberg ..... B23K 35/3603 148/26
2,817,895 A * 12/1957 Chill ..... B23K 35/3603 148/26
2,840,499 A * 6/1958 Aronberg ..... B23K 35/3603 148/23
3,723,160 A * 3/1973 Tanaka ..... C23C 24/106 106/1.17
3,943,270 A * 3/1976 Neu ..... C23C 2/30 106/1.11
6,921,439 B2 7/2005 Warichet et al.
7,560,494 B2 7/2009 Steinbrenner et al.
2003/0219543 A1* 11/2003 Warichet ..... C23C 2/06 427/433
2007/0137731 A1* 6/2007 Leychkis ..... B23K 35/34 148/23

FOREIGN PATENT DOCUMENTS

| | | | | |
|---|---|---|---|---|
| CN | 101948990 | | 1/2011 | |
| EP | 0488423 | | 6/1992 | |
| EP | 0905270 | | 3/1999 | |
| EP | 1209245 | | 5/2002 | |
| GB | 1040958 | | 9/1966 | |
| JP | 2001049414 | | 2/2001 | |
| JP | 2001049414 | A * | 2/2001 | ..... C23C 2/06 |
| PL | 134965 | * | 7/1984 | ..... C23C 1/02 |
| WO | 2007/146161 | | 12/2007 | |

OTHER PUBLICATIONS

G. M. Patel. "Applications of Non-Ionic Surfactants—Fatty Amine Ethoxylates, Fatty Alcohol Ethoxylates, Nonyl Phenol Ethoxylates." Rimpro India. http://www.rimpro-india.com/articlesl/applications-of-non-ionic-surfactants-fatty-amine-ethoxylates,-fatty-alcohol-ethoxylates,-nonyl-phenol-ethoxylates.html Accessed Feb. 25, 2016.*
PL 134965 English abstract.*
Eagleson, Mary. (1993). Concise Encyclopedia Chemistry. De Gruyter. Photosystems to Polarograhy pp. 832-853.*
JP 2001-049414 machine translation.*
PL 134965 written English translation (Year: 1984).*
"Surfactant" Chemical Compound. Published Mar. 10, 2016. (Year: 2016).*
"Next Level HDG Technologies," Fontaine Technologie, Jul. 25, 2012, XP002719188.

* cited by examiner

*Primary Examiner* — Paul A Wartalowicz
*Assistant Examiner* — Stephani Hill
(74) *Attorney, Agent, or Firm* — Duane Morris LLP; Gregory M. Lefkowitz; Jason M. Nolan

(57) ABSTRACT

A flux composition for treating a metal surface prior to batch hot galvanizing in molten zinc-based alloys is disclosed. The flux composition can include (a) 40 to 70 wt. % zinc chloride, (b) 10 to 30 wt. % ammonium chloride, (c) 6 to 30 wt. % of a set of at least two alkali or alkaline earth metal halides, (d) from 0.1 to 2 wt. % lead chloride, and (e) from 2 to 15 wt. % tin chloride, provided that the combined amounts of lead chloride and tin chloride represent at least 2.5 wt. % of the composition. A fluxing bath having this flux composition dissolved in water for use in galvanizing processes, as well as, a method for continuous or batch-wise treatment of metal articles in order to produce a protective coating layer with a thickness ranging from 5 to 30 μm is also disclosed.

22 Claims, No Drawings

FLUX COMPOSITIONS FOR STEEL GALVANIZATION

This application claims the benefit of British Patent Application No. 1219213.4 filed Oct. 25, 2012, the disclosure of which is incorporated by reference in its entirety.

FIELD OF THE INVENTION

The present invention relates to the field of galvanization, more specifically hot dip galvanization or hot-dip zinc coating. In particular the present invention relates to the galvanization of ferrous materials such as, but not limited to, iron, cast iron, steel and cast steel. More particularly the present invention relates to a range of flux compositions for treating the surface of a ferrous material such as iron and steel before it is dipped into a zinc-based molten bath. The present invention also relates to (1) galvanization processes, in particular hot dip galvanization, making use of the flux compositions in at least one process step, and (2) galvanized products, including galvanized ferrous products (e.g. steel flat and long products), made by a process wherein the product surface is treated with the novel flux compositions.

BACKGROUND OF THE INVENTION

The importance of providing protection against corrosion for ferrous (e.g. iron or steel) articles used outdoors such as fences, wires, bolts, cast iron elbows and automobile parts is well known, and coating a ferrous material with zinc is a very effective and economical means for accomplishing this goal. Zinc coatings are commonly applied by dipping or passing the article to be coated through a molten bath of the metal. This operation is termed "galvanizing", "hot galvanizing" or "hot-dip galvanizing" (HDG) to distinguish it from zinc electroplating processes. In this process, a solidified layer of zinc is formed on the article surface and the zinc coating layer formed as a result is strongly adhered to the surface of the article by an iron/zinc intermetallic alloy which forms during galvanizing. Oxides and other foreign materials ("soil") on the surface of the steel article interfere with the chemistry of the galvanizing process and prevent formation of a uniform, continuous, void-free coating. Accordingly, various techniques and combinations of techniques have been adopted in industry to reduce, eliminate, or at least accommodate, oxides and soil as much as possible.

Improvement in the properties of galvanized products can be achieved by alloying zinc with aluminum and/or magnesium. Addition of 5 wt. % aluminum produces an alloy with a lower melting temperature (eutectic point at 381° C.) which exhibits improved drainage properties relative to pure zinc. Moreover, galvanized coatings produced from this zinc-aluminum alloy have greater corrosion resistance, improved formability and better paintability than those formed from essentially pure zinc. However, zinc-aluminum galvanizing is particularly sensitive to surface cleanliness so that various difficulties, such as insufficient steel surface wetting, are often encountered when zinc-aluminum alloys are used in galvanizing.

Many techniques and combinations thereof have been adopted in industry to reduce, eliminate, or at least accommodate, oxides and soil as much as possible. In essentially all these processes, organic soil (i.e. oil, grease, rust preventive compounds), is first removed by contacting the surface to be coated with an alkaline aqueous wash (alkaline cleaning). This may be accompanied by additional techniques such as brush scrubbing, ultrasound treatment and/or electro-cleaning. Then follows rinsing with water, contacting the surface with an acidic aqueous wash for removing iron fines and oxides (pickling), and finally rinsing with water again. All these cleaning-pickling-rinsing procedures are common for most galvanizing techniques and are industrially carried out more or less accurately.

Another pre-treatment method used for high strength steels, steels with high carbon contents, cast iron and cast steels is a mechanical cleaning method called blasting. In this method, rust and dirt are removed from the steel or iron surface by projecting small shots and grits onto this surface. Depending on the shape, size and thickness of the parts to be treated, different blasting machines are used such as a tumble blasting machine for bolts, a tunnel blasting machine for automotive parts, etc.

There are two main galvanizing techniques used on cleaned metal (e.g. iron or steel) parts: (1) the fluxing method, and (2) the annealing furnace method.

The first galvanizing technique, i.e. the fluxing method, may itself be divided into two categories, the dry fluxing method and the wet fluxing method.

The dry fluxing method, which may be used in combination with one or more of the above cleaning, pickling, rinsing or blasting procedures, creates a salt layer on the ferrous metal surface by dipping the metal part into an aqueous bath containing chloride salts, called a "pre-flux". Afterwards, this layer is dried prior to the galvanizing operation, thus protecting the steel surface from re-oxidation until its entrance in a molten zinc bath. Such pre-fluxes normally comprise aqueous zinc chloride and optionally contain ammonium chloride, the presence of which has been found to improve wettability of the article surface by molten zinc and thereby promote formation of a uniform, continuous, void-free coating.

The concept of wet fluxing is to cover the galvanizing bath with a top flux also typically comprising zinc chloride, and usually ammonium chloride, but in this case these salts are molten and are floating on the top of the galvanizing bath. The purpose of a top flux, like a pre-flux, is to supply zinc chloride and preferably ammonium chloride to the system to aid wettability during galvanizing. In this case, all surface oxides and soil which are left after cleaning-pickling-rinsing are removed when the steel part passes through the top flux layer and is dipped into the galvanizing kettle. Wet fluxing has several disadvantages such as, consuming much more zinc than dry fluxing, producing much more fumes, etc. Therefore, the majority of galvanizing plants today have switched their process to the dry fluxing method.

Below is a summary of the annealing furnace method. In continuous processes using zinc or zinc-aluminum or zinc-aluminum-magnesium alloys as the galvanizing medium, annealing is done under a reducing atmosphere such as a mixture of nitrogen and hydrogen gas. This not only eliminates re-oxidation of previously cleaned, pickled and rinsed surfaces but, also actually removes any residual surface oxides and soil that might still be present. The majority of steel coils are today galvanized according to this technology. A very important requirement is that the coil is leaving the annealing furnace by continuously going directly into the molten zinc without any contact with air. However this requirement makes it extremely difficult to use this technology for shaped parts, or for steel wire since wires break too often and the annealing furnace method does not allow discontinuity.

Another technique used for producing zinc-aluminum galvanized coatings comprises electro-coating the steel articles with a thin (i.e. 0.5-0.7 μm) layer of zinc (hereafter "pre-layer"), drying in a furnace with an air atmosphere and then dipping the pre-coated article into the galvanizing kettle. This is widely used for hot-dip coating of steel tubing in continuous lines and to a lesser extent for the production of steel strip. Although this does not require processing under reducing atmospheres, it is disadvantageous because an additional metal-coating step required.

Galvanizing is practiced either in batch operation or continuously. Continuous operation is typically practiced on articles amenable to this type of operation such as wire, sheet, strip, tubing, and the like. In continuous operation, transfer of the articles between successive treatments steps is very fast and done continuously and automatically, with operating personnel being present to monitor operations and fix problems if they occur. Production volumes in continuous operations are high. In a continuous galvanizing line involving use of an aqueous pre-flux followed by drying in a furnace, the time elapsing between removal of the article from the pre-flux tank and dipping into the galvanizing bath is usually about 10 to 60 seconds, instead of 10 to 60 minutes for a batch process.

Batch operations are considerably different. Batch operations are favored where production volumes are lower and the parts to be galvanized are more complex in shape. For example, various fabricated steel items, structural steel shapes and pipe are advantageously galvanized in batch operations. In batch operations, the parts to be processed are manually transferred to each successive treatment step in batches, with little or no automation being involved. This means that the time each piece resides in a particular treatment step is much longer than in continuous operation, and even more significantly, the time between successive treatment steps is much wider in variance than in continuous operation. For example, in a typical batch process for galvanizing steel pipe, a batch of as many as 100 pipes after being dipped together in a pre-flux bath is transferred by means of a manually operated crane to a table for feeding, one at a time, into the galvanizing bath.

Because of the procedural and scale differences between batch and continuous operations, techniques particularly useful in one type of operation are not necessarily useful in the other. For example, the use of a reducing furnace is restricted to continuous operation on a commercial or industrial scale. Also, the high production rates involved in continuous processes make preheating a valuable aid in supplying make-up heat to the galvanizing bath. In batch processes, delay times are much longer and moreover production rates, and hence the rate of heat energy depletion of the galvanizing bath, are much lower.

There is a need to combine good formability with enhanced corrosion protection of the ferrous metal article. However, before a zinc-based alloy coating with high amounts of aluminum (and optionally magnesium) can be introduced into the general galvanizing industry, the following difficulties have to be overcome:

- zinc alloys with high aluminum contents can hardly be produced using the standard zinc-ammonium chloride flux. Fluxes with metallic Cu or Bi deposits have been proposed earlier, but the possibility of copper or bismuth leaching into the zinc bath is not attractive. Thus, better fluxes are needed.
- high-aluminum content alloys tend to form outbursts of zinc-iron intermetallic alloy which are detrimental at a later stage in the galvanization. This phenomenon leads to very thick, uncontrolled and rough coatings. Control of outbursts is absolutely essential.
- wettability issues were previously reported in Zn—Al alloys with high-aluminum content, possibly due to a higher surface tension than pure zinc. Hence bare spots due to a poor wetting of steel are easily formed, and hence a need to lower the surface tension of the melt.
- a poor control of coating thickness was reported. in Zn—Al alloys with high-aluminum content, possibly depending upon parameters such as temperature, flux composition, dipping time, steel quality, etc.

WO 02/42512 describes a flux for hot dip galvanization comprising 60-80 wt. % zinc chloride; 7-20 wt. % ammonium chloride; 2-20 wt. % of at least one alkali or alkaline earth metal salt; 0.1-5 wt. % of a least one of $NiCl_2$, $CoCl_2$ and $MnCl_2$; and 0.1-1.5 wt. % of at least one of $PbCl_2$, $SnCl_2$, $SbCl_3$ and $BiCl_3$. Preferably this flux comprises 6 wt. % NaCl and 2 wt. % KCl. Examples 1-3 teach flux compositions comprising 0.7-1 wt. % lead chloride.

WO 2007/146161 describes a method of galvanizing with a molten zinc-alloy comprising the steps of (1) immersing a ferrous material to be coated in a flux bath in an independent vessel thereby creating a flux coated ferrous material, and (2) thereafter immersing the flux coated ferrous material in a molten zinc-aluminum alloy bath in a separate vessel to be coated with a zinc-aluminum alloy layer, wherein the molten zinc-aluminum alloy comprises 10-40 wt. % aluminum, at least 0.2 wt. % silicon, and the balance being zinc and optionally comprising one or more additional elements selected from the group consisting of magnesium and a rare earth element. In step (1), the flux bath may comprise from 10-40 wt. % zinc chloride, 1-15 wt. % ammonium chloride, 1-15 wt. % of an alkali metal chloride, a surfactant and an acidic component such that the flux has a final pH of 1.5 or less. In another embodiment of step (1), the flux bath may be as defined in WO 02/42512.

JP 2001/049414 describes producing a hot-dip Zn—Mg—Al base alloy coated steel sheet excellent in corrosion resistance by hot-dipping in a flux containing 61-80 wt. % zinc chloride, 5-20 wt. % ammonium chloride, 5-15 wt. % of one or more chloride, fluoride or silicafluoride of alkali or an alkaline earth metal, and 0.01-5 wt. % of one or more chlorides of Sn, Pb, In, Tl, Sb or Bi. More specifically, table 1 of JP 2001/049414 discloses various flux compositions with a KCl/NaCl weight ratio ranging from 0.38 to 0.60 which, when applied to a steel sheet in a molten alloy bath comprising 0.05-7 wt. % Mg, 0.01-20 wt. % Al and the balance being zinc, provide a good plating ability, no pin hole, no dross, and flat. By contrast, table 1 of JP 2001/049414 discloses a flux composition with a KCl/NaCl weight ratio of 1.0 which, when applied to a steel sheet in a molten alloy bath comprising 1 wt. % Mg, 5 wt. % Al and the balance being zinc, provides a poor plating ability, pin hole defect, some dross, and poorly flat.

Thus, the common teaching of the prior art is a preferred KCl/NaCl weight ratio below 1.0 in the fluxing composition. However the prior art has still not resolved most of the technical problems outlined hereinbefore. Consequently there is still a need in the art for improved fluxing compositions and galvanizing methods making use thereof.

SUMMARY OF THE INVENTION

The object of the present invention is to provide a flux composition making it possible to produce continuous, more uniform, smoother and void-free coatings on metal articles, in particular iron or steel articles, of any shape by hot dip galvanization with pure zinc or zinc alloys, in particular zinc-aluminum alloys and zinc-aluminum-magnesium alloys of various compositions. It has surprisingly been found that this can be achieved by providing both lead chloride and tin chloride in specific amounts in the flux composition. Most of the hereinabove stated problems are thus solved by a flux composition as defined in claim 1 and a galvanization process as defined in claim 11. Specific embodiments are defined in dependent claims 2-10 and 12-18.

DETAILED DESCRIPTION OF THE INVENTION

The main feature of the present invention is the recognition that huge improvements in galvanization of metals, in particular iron and steel, can be achieved when selecting a flux composition comprising both lead chloride and tin chloride in specified respective amounts and with a proviso that their combined amounts exceed a certain threshold being above what was previously known from the literature. This main feature is associated with specific amounts of the other components of the flux composition, as defined in claim 1.

Definitions

The term "hot dip galvanization" is meant to designate the corrosion treatment of a metal article such as, but not limited to, an iron or steel article by dipping into a molten bath of pure zinc or a zinc-alloy, in continuous or batch operation, for a sufficient period of time to create a protective layer at the surface of said article. The term "pure zinc" refers to zinc galvanizing baths that may contain trace amounts of some additives such as for instance antimony, bismuth, nickel or cobalt. This is in contrast with "zinc alloys" that contain significant amounts of one or more other metals such as aluminum or magnesium.

In the following the different percentages relate to the proportion by weight (wt. %) of each component with respect to the total weight (100%) of the flux composition. This implies that not all maximum or not all minimum percentages can be present at the same time, in order for their sum to match to 100% by weight.

The flux composition of this invention comprises, as an essential feature, 0.1-2 wt. % lead chloride and 2-15 wt. % tin chloride, with the proviso that the combined amounts of lead chloride and tin chloride represent at least 2.5 wt % of said composition. Various specific embodiments of the flux composition of this invention are defined in claims 2 to 11 and are further presented in details.

In one embodiment, the proportion of lead chloride in the flux composition is at least 0.4 wt. % or at least 0.7 wt. %. In another embodiment, the proportion of lead chloride in the flux composition is at most 1.5 wt % or at most 1.2 wt. %. In a specific embodiment, the proportion of lead chloride in the flux composition is 0.8 to 1.1 wt. %.

In one embodiment, the proportion of tin chloride in the flux composition is at least 2 wt. % or at least 3.5 wt. % or at least 7 wt. %. In another embodiment, the proportion of tin chloride in the flux composition is at most 14 wt. %.

In one embodiment, the combined amounts of lead chloride and tin chloride represent at least 4.5 wt. %, or at most 14 wt. % of the flux composition. In another embodiment, the flux composition may further comprise other salts of lead and/or tin, e.g. the fluoride, or other chemicals that are inevitable impurities present in commercial sources of lead chloride and/or tin chloride.

In one aspect of this invention, the specified respective amounts of lead chloride and tin chloride in the flux composition are combined with specified proportions of all other chlorides that make it possible to produce continuous, more uniform, smoother and void-free coatings on metal, in particular iron or steel, articles by galvanization, in particular hot dip galvanization, processes with molten zinc or zinc-based alloys, especially in batch operation or continuously.

For instance, the respective amounts of lead chloride and tin chloride in the flux composition are combined with more than 40 and less than 70 wt. % zinc chloride. In one embodiment, the proportion of zinc chloride in the flux composition is at least 45 wt. % or at least 50 wt. %. In another embodiment, the proportion of zinc chloride in the flux composition is at most 65 wt. % or at most 62 wt. %. Such proportions of $ZnCl_2$ are able, in combination with the respective amounts of lead chloride and tin chloride in the flux composition, to ensure a good coating of the metal article to be galvanized and to effectively prevent oxidation of the metal article during subsequent process steps such as drying, i.e. prior to galvanization itself.

In one aspect of this invention, the respective amounts of lead chloride and tin chloride in the flux composition are combined with 10-30 wt. % ammonium chloride. In one embodiment, the proportion of $NH_4Cl$ in the flux composition is at least 13 wt. % or at least 17 wt. %. In another embodiment, the proportion of ammonium chloride in the flux composition is at most 26 wt. % or at most 22 wt. %. The optimum proportion of $NH_4Cl$ may be determined by the skilled person, without extensive experimentation and depending upon parameters such as the metal to be galvanized and the weight proportions of the metal chlorides in the flux composition, by simply using the experimental evidence shown in the following examples, to achieve a sufficient etching effect during hot dipping to remove residual rust or poorly pickled spots, while however avoiding the formation of black spots, i.e. uncoated areas of the metal article. In some circumstances it may be useful to substitute a minor part (e.g. less than ⅓ by weight) of $NH_4Cl$ with one or more alkyl quaternary ammonium salt(s) wherein at least one alkyl group has from 8 to 18 carbon atoms such as described in EP 0488.423, for instance an alkyl-trimethylammonium chloride (e.g. trimethyllauryl-ammonium chloride) or a dialkyldimethylammonium chloride.

In one aspect of this invention, the respective amounts of lead chloride and tin chloride in the flux composition are further combined with suitable amounts of one or more, preferably several, alkali or alkaline earth metal halides. Such halides are preferably or predominantly chlorides (fluorides, bromides and iodides may be useful as well), and the alkali or alkaline earth metals are advantageously selected (sorted in decreasing order of preference in each metal class) from the group consisting of Na, K, Li, Cs, Mg, Ca, Sr and Ba. The flux composition shall advantageously comprise a mixture of these alkali or alkaline earth metal halides, since such mixtures tend to increase the average chemical affinity of the molten mixture towards chlorine and to provide a synergistic effect allows to better and more accurately control the melting point and the viscosity of the molten salts and hence the wettability. In one embodiment, the mixture of alkali or alkaline earth metal halides is a set of at least two alkali metal chlorides and represents 10-30 wt. % of the flux composition. In another embodiment, the set of at least two alkali metal chlorides includes sodium chloride and potassium chloride as major components. In another embodiment, the set of at least two alkali metal chlorides (e.g. NaCl and KCl as major components) represents at least 12 wt. % or at least 15 wt. % of the flux composition. In another embodiment, the set of at least two alkali metal chlorides (e.g. including sodium chloride and potassium chloride as major components) represents at most 25 wt. %, or at most 21 wt. %, of the flux composition. In another embodiment, the proportion of the at least two alkali metal chlorides (e.g. including sodium chloride and potassium chloride as major components) in the flux composition is 20-25 wt. %. Magnesium chloride and/or calcium chloride may be present as well as minor components in each of the above stated embodiments.

In order to achieve the best possible advantages, the ratio between these alkali or alkaline earth metal halides in their mixtures is not without importance. As is known from the prior art the mixture of alkali or alkaline earth metal halides may be a set of at least two alkali metal chlorides including sodium chloride and potassium chloride in a KCl/NaCl weight ratio from 0.2 to 1.0. In one embodiment, the KCl/NaCl weight ratio may be from 0.25 to 0.6. In one embodiment, the KCl/NaCl weight ratio may be from 1.0 to 2.0. It has also been surprisingly found that flux compositions wherein the mixture of alkali or alkaline earth metal halides is a set of at least two alkali metal chlorides including sodium chloride and potassium chloride in a KCl/NaCl weight ratio from 2.0 to 8.0 exhibit outstanding properties. In anyone embodiment, the KCl/NaCl weight ratio may be from 3.5 to 5.0, or from 3.0 to 6.0.

In one aspect of this invention, the respective amounts of lead chloride and tin chloride in the flux composition are further combined with suitable amounts of one or more other metal (e.g. transition metal or rare earth metal) chlorides such as nickel chloride, cobalt chloride, manganese chloride, cerium chloride and lanthanum chloride. For instance, some examples below demonstrate that the presence of up to 1 wt. % (even up to 1.5 wt. %) nickel chloride is not detrimental to the behavior of the flux composition in terms of quality of the coating obtained after hot dip galvanization.

In other aspects of this invention, the respective amounts of lead chloride and tin chloride in the flux composition are further combined with other additives, preferably functional additives participating in tuning or improving some desirable properties of the flux composition. Such additives are presented below.

For instance the flux composition of this invention may further comprise at least one nonionic surfactant or wetting agent which, when combined with the other ingredients, is capable of achieving a predetermined desirable surface tension. Essentially any type of nonionic surfactant, but preferably liquid water-soluble, can be used. Examples thereof include ethoxylated alcohols such as nonyl phenol ethoxylate, alkyl phenols such as Triton X-102 and Triton N101 (e.g. from Union Carbide), block copolymers of ethylene oxide and propylene oxide such as L-44 (from BASF), and tertiary amine ethoxylates derived from coconut, soybean, oleic or tallow oils (e.g. Ethomeen from AKZO NOBEL), polyethoxylated and polypropoxylated derivatives of alkylphenols, fatty alcohols, fatty acids, aliphatic amines or amides containing at least 12 carbon atoms in the molecule, alkylarene-sulfonates and dialkylsulfosuccinates, such as polyglycol ether derivatives of aliphatic and cycloaliphatic alcohols, saturated and unsaturated fatty acids and alkylphenols, said derivatives preferably containing 3-10 glycol ether groups and 8-20 carbon atoms in the (aliphatic) hydrocarbon moiety and 6-18 carbon atoms in the alkyl moiety of the alkylphenol, water-soluble adducts of polyethylene oxide with poylypropylene glycol, ethylenediaminopolypropylene glycol containing 1-10 carbon atoms in the alkyl chain, which adducts contain 20-250 ethyleneglycol ether groups and/or 10-100 propyleneglycol ether groups, and mixtures thereof. Such compounds usually contain from 1-5 ethyleneglycol (EO) units per propyleneglycol unit. Representative examples are nonylphenol-polyethoxyethanol, castor oil polyglycolic ethers, polypropylene-polyethylene oxide adducts, tributylphenoxypolyethoxy-ethanol, polyethylene-glycol and octylphenoxypolyethoxyethanol. Fatty acid esters of polyethylene sorbitan (such as polyoxyethylene sorbitan trioleate), glycerol, sorbitan, sucrose and pentaerythritol, and mixtures thereof, are also suitable non-ionic surfactants. Low foaming wetting agents such as the ternary mixtures described in U.S. Pat. No. 7,560,494 are also suitable. Commercially available non-ionic surfactants of the above-mentioned types include those marketed by Zschimmer & Schwarz GmbH & Co KG (Lahnstein, Germany) under the trade names OXETAL, ZUSOLAT and PROPETAL, and those marketed by Alfa Kimya (Istanbul, Turkey) under the trade name NETZER SB II. Various grades of suitable non-ionic surfactants are available under the trade name MERPOL.

The hydrophilic-lipophilic balance (HLB) of said at least one nonionic surfactant is not a critical parameter of this invention and may be selected by the skilled person within a wide range from 3 to 18, for instance from 6 to 16. E.g. the HLB of MERPOL-A is 6 to 7, the HLB of MERPOL-SE is 11, and the HLB of MERPOL-HCS is 15. Another feature of the nonionic surfactant is its cloud point (i.e. the temperature of phase separation as may be determined e.g. by ASTM D2024-09 standard test method; this behavior is characteristic of non-ionic surfactants containing polyoxyethylene chains, which exhibit reverse solubility versus temperature in water and therefore "cloud out" at some point as the temperature is raised; glycols demonstrating this behavior are known as "cloud-point glycols") which should preferably be higher than the flux working temperature as defined below with respect to the use of a fluxing bath in a hot dip galvanization process. Preferably the cloud point of the nonionic surfactant should be higher than 90° C.

Suitable amounts of nonionic surfactants are well known from the skilled person and usually range from 0.02 to 2.0 wt. %, preferably from 0.5 to 1.0 wt. %, of the flux composition, depending upon the selected type of compound.

The flux compositions of the invention may further comprise at least one corrosion inhibitor, i.e. a compound inhibiting the oxidation of steel particularly in oxidative or acidic conditions. In one embodiment, the corrosion inhibitor includes at least an amino group. Inclusion of such amino derivative corrosion inhibitors in the flux compositions can significantly reduce the rate of iron accumulation in the flux tank. By "amino derivative corrosion inhibitor" is meant herein a compound which inhibits the oxidation of steel and contains an amino group. Aliphatic alkyl amines and quaternary ammonium salts (preferably containing 4 independently selected alkyl groups with 1-12 carbon atoms) such as alkyl dimethyl quaternary ammonium nitrate are suitable examples of this type of amino compounds. Other suitable examples include hexamethylenediamines. In another embodiment, the corrosion inhibitor includes at least one hydroxyl group, or both a hydroxyl group and an amino group and are well known to those skilled in the art. Suitable amounts of the corrosion inhibitor are well known from the skilled person and usually range from 0.02 to 2.0 wt. %, preferably 0.1-1.5 wt. %, or 0.2-1.0 wt. %, depending upon the selected type of compound. The flux compositions of the invention may comprise both at least one corrosion inhibitor and a nonionic surfactant or wetting agent as defined hereinabove.

The flux compositions of the invention may be produced by various methods. They can simply be produced by mixing, preferably thoroughly (e.g. under high shear), the essential components (i.e. zinc chloride, ammonium chloride, alkali and/or alkaline metalhalide(s), lead chloride and tin chloride) and, if need be, the optional ingredients (i.e. alkyl quaternary ammonium salt(s), other transition or rare earth metal chlorides, corrosion inhibitor(s) and/or nonionic surfactant(s)) in any possible order in one or more mixing steps. The flux compositions of the invention may also be produced by a sequence of at least two steps, wherein one step comprises the dissolution of lead chloride in ammonium chloride or sodium chloride or a mixture thereof, and wherein in a further step the solution of lead chloride in ammonium chloride or sodium chloride or a mixture thereof is then mixed with the other essential components (i.e. zinc chloride, potassium chloride, tin chloride) and, if need be, the optional ingredients (as listed above) of the composition. In one embodiment of the latter method, dissolution of lead chloride is carried out in the presence of water. In another embodiment of the latter method, it is useful to dissolve an amount ranging from 8 to 35 g/l lead chloride in an aqueous mixture comprising from 150 to 450 g/l ammonium chloride and/or or sodium chloride and the balance being water. In particular the latter dissolution step may be performed at a temperature ranging from 55° C. to 75° C. for a period of time ranging from 4 to 30 minutes and preferably with stirring.

A significant advantage of a flux composition of the invention is its broad field of applicability (use). The present flux compositions are particularly suitable for batch hot dip galvanizing processes using a wide range of zinc alloys but also pure zinc. Moreover, the present flux can also be used in continuous galvanizing processes using either zinc-aluminum or zinc-aluminum-magnesium or pure zinc baths, for galvanizing a wide range of metal pieces (e.g. wires, pipes, tubes, coils, sheets) especially from ferrous materials like iron and steel (e.g. steel flat and long products).

According to another aspect, the present invention thus relates to a fluxing bath for galvanization, in particular hot dip galvanization, wherein a suitable amount of a flux composition according to any one of the above embodiments is dissolved in water or an aqueous medium. Methods for water-dissolving a flux composition based on zinc chloride, ammonium chloride, alkali or alkaline earth metal chlorides and one or more transition metal chlorides (e.g. lead, tin) and optionally other metal chlorides (nickel, cobalt, cerium, lanthanum) are well known in the art. The total concentration of components of the flux composition in the fluxing bath may range within very wide limits such as 200-750 g/l, preferably 350-750 g/l, most preferably 500-750 g/l or 600-750 g/l. This fluxing bath is particularly adapted for hot dip galvanizing processes using zinc-aluminum baths, but also with pure zinc galvanizing baths, either in batch or continuous operation.

The fluxing bath used in the process (whether batch or continuous) of the invention should advantageously be maintained at a temperature between 50° C. and 90° C., preferably 60° C.–90° C., most preferably 65° C.–85° C. The process comprises a step of treating (fluxing), e.g. immersing, a metal article in a fluxing bath according to any one of the above embodiments. Preferably, in discontinuous (batch) operation, said treatment step is performed at a speed output in the range of 1-12 m/min. or 2-8 m/min, for a period of time ranging from 0.01 to 30 minutes, or 0.03 to 20 minutes, or 0.5 to 15 minutes, or 1 to 10 minutes depending upon operating parameters such as the composition and/or temperature of the fluxing bath, the composition of the metal (e.g. steel) to be galvanized, the shape and/or size of the article. As is well known to the skilled person, the treatment time may widely vary from one article to the other: the shorter times (close to or even below 0.1 minute) are suitable for wires, whereas the longer times (closer to 15 minutes or more) are more suitable for instance for rods. In continuous operation, the metal treatment step, i.e. immersion in the fluxing bath, may be performed at a speed from 0.5 to 10 m/minute, or 1-5 m/minute. Much higher speeds of 10-100 m/min, e.g. 20-60 m/min, can also be achieved.

Practically, any metal surface susceptible to corrosion, for instance any type of iron or steel article may be treated this way. The shape (flat or not), geometry (complex or not) or the size of the metal article are not critical parameters of the present invention. The article to be galvanized may be a so-called long product. As used herein the term "long product" refers to products with one dimension (length) being at least 10 times higher than the two other dimensions (as opposed to flat products wherein two dimensions (length and width) are at least 10 times higher than thickness, the third dimension) such as, wires (coiled or not, for making e.g. bolts and fences), rods, bobbins, reinforcing bars, tubes (welded or seamless), rails, structural shapes and sections (e.g. I-beams, H-beams, L-beams, T-beams and the like), or pipes of any dimensions e.g. for use in civil construction, mechanical engineering, energy, transport (railway, tramway), household and furniture. The metal article to be galvanized may also be, without limitation, in the form of a flat product such as plates, sheets, panels, hot-rolled and cold-rolled strips (either wide 600 mm and above, or narrow below 600 mm, supplied in regularly wound coils or super imposed layers) being rolled from slabs (50-250 mm thick, 0.6-2.6 m wide, and up to 12 m long) and being useful in automotive, heavy machinery, construction, packaging and appliances.

It is important in any galvanizing process for the surface of the article to be galvanized to be suitably cleaned before performing the fluxing step. Techniques for achieving a desirable degree of surface cleanliness are well known in the art, and may be repeated, such as alkaline cleaning, followed by aqueous rinsing, pickling in acid and finally aqueous rinse. Although all of these procedures are well known, the following description is presented for the purpose of completeness.

Alkaline cleaning can conveniently be carried out with an aqueous alkaline composition also containing phosphates and silicates as builders as well as various surfactants. The free alkalinity of such aqueous cleaners can vary broadly. Thus at an initial process step, the metal article is submitted to cleaning (degreasing) in a degreasing bath such as an ultrasonic, alkali degreasing bath. Then, in a second step, the degreased metal article is rinsed. Next the metal article is submitted to one or more pickling treatment(s) by immersion into an aqueous strongly acidic medium, e.g. hydrochloric acid or sulfuric acid, usually at a temperature from 15° C. to 60° C. and during 1-90 minutes (preferably 3-60 minutes), and optionally in the presence of a ferrous and/or ferric chloride. Acid concentrations of about 5 to 15 wt. %, e.g. 8-12 wt. %, are normally used, although more concentrated acids can be used. In a continuous process the pickling time typically ranges from 5 to 30 seconds, more typically 10 to 15 seconds. In order to prevent over-pickling, one may include in the pickling bath at least one corrosion inhibitor, typically a cationic or amphoteric surface active agent, typically in an amount ranging from 0.02 to 0.2 wt. %, preferably 0.05-0.1 wt. %. Pickling can be accomplished simply by dipping the article in a pickling tank. Additional processing steps can also be used. For example, the article can be agitated either mechanically or ultrasonically, and/or an electric current can be passed through the article for electro-pickling. As is well known these additional processing means usually shorten pickling time significantly. Clearly these pre-treatment steps may be repeated individually or by cycle if needed until the desirable degree of cleanliness is achieved. Then, preferably immediately after the cleaning steps, the metal article is treated (fluxed), e.g. immersed, in a fluxing bath of the invention, preferably under the total salt concentration, temperature and time conditions specified above, in order to form a protective film on its surface.

The fluxed metal (e.g. iron or steel) article, i.e. after immersion in the fluxing bath during the appropriate period of time and the suitable temperature, is preferably subsequently dried. Drying may be effected, according to prior art conditions, by transferring the fluxed metal article through a furnace having an air atmosphere, for instance a forced air stream, where it is heated at a temperature from 220° C. to 250° C. until its surface exhibited a temperature between 170° C. and 200° C., e.g. for 5 to 10 minutes. However it has also been surprisingly found that milder heating conditions may be more appropriate when a fluxing composition of the invention, or any particular embodiment thereof, is used.

Thus it has been found that it may be sufficient for the surface of the metal (e.g. steel) article to exhibit a temperature from 100° to 200° C. during the drying step. This can be achieved for instance by using a heating temperature ranging from 100° C. to 200° C. This can also be achieved by using a poorly oxidative atmosphere during the drying step. In one embodiment of the invention, the surface temperature of the metal article may range from 100° C. to 160° C., or 125-150° C., or 140-170° C. In another embodiment of this invention, drying may be effected for a period of time ranging from 0.5 to 10 minutes, or 1-5 minutes. In another embodiment of this invention, drying may be effected in specific gas atmospheres such as, but not limited to a water-depleted air atmosphere, a water-depleted nitrogen atmosphere, or a water-depleted nitrogen-enriched air atmosphere (e.g. wherein the nitrogen content is above 20%).

At a next step of the galvanization process, the fluxed and dried metal article may be dipped into a molten zinc-based galvanizing bath to form a metal coating thereon. As is well known, the dipping time may be defined depending upon a set of parameters including the size and shape (e.g. flat or long) of the article, the desired coating thickness, and the exact composition of the zinc bath, in particular its aluminum content (when a Zn—Al alloy is used as the galvanizing bath) or magnesium content (when a Zn—Al—Mg alloy is used as the galvanizing bath). In one embodiment, the molten zinc-based galvanizing bath may comprise (a) from 4 to 24 wt. % (e.g. 5 to 20 wt. %) aluminum, (b) from 0.5 to 6 wt. % (e.g. 1 to 4 wt. %) magnesium, and (c) the rest being essentially zinc. In another embodiment, the molten zinc-based galvanizing bath may comprise tiny amounts (i.e. below 1.0 wt. %) or trace amounts (i.e. unavoidable impurities) of other elements such as, but not limited to, silicon (e.g. up to 0.3 wt. %), tin, lead, titanium or vanadium. In another embodiment, the molten zinc-based galvanizing bath may be agitated during a part of this treatment step. During this process step the zinc-based galvanizing bath is preferably maintained at a temperature ranging from 360° C. to 600° C. It has been surprisingly found that with the flux composition of the invention it is possible to lower the temperature of the dipping step whilst obtaining thin protective coating layers of a good quality, i.e. which are capable of maintaining their protective effect for an extended period of time such as five years or more, or even 10 years or more, depending upon the type of environmental conditions (air humidity, temperature, and so on). Thus in one embodiment of the invention, the molten zinc-based galvanizing bath is kept at a temperature ranging from 350° C. to 550° C., or 380-520° C., or 420-520° C., the optimum temperature depending upon the content of aluminum and/or magnesium optionally present in the zinc-based bath. In another particular embodiment of the galvanization process of the invention, dipping is performed at a temperature ranging between 380° C. and 440° C., and said molten zinc-based galvanizing bath comprises (a) from 4 to 7 weight % aluminum, (b) from 0.5 to 3 weight % magnesium, and (c) the rest being essentially zinc.

In one embodiment of the present invention, the thickness of the protective coating layer obtained by carrying out the dipping step on a metal article, e.g. an iron or steel article, that has been pre-treated with the flux composition of this invention may range from 5 to 50 μm, for instance from 8 to 30 μm. This can be appropriately selected by the skilled person, depending upon a set of parameters including the thickness and/or shape of the metal article, the stress and environmental conditions that the metal article is supposed to withstand during its lifetime, the expected durability in time of the protective coating layer formed, and so on. For instance a 5-15 μm thick coating layer is suitable for a steel article being less than 1.5 mm thick, and a 20-35 μm thick coating layer is suitable for a steel article being more than 6 mm thick.

Finally, the metal article, e.g. the iron or steel article, is removed from the galvanizing bath and cooled. This cooling step may conveniently be carried out either by dipping the galvanized metal article in water or simply by allowing it to cool down in air.

The present hot dip galvanization process has been found to allow the continuous or batch deposition of thinner, more uniform, smoother and void-free, protective coating layers on iron or steel articles (both flat and long products), especially when a zinc-aluminum or zinc-aluminum-magnesium galvanizing bath with not more than 95% zinc was used. Regarding roughness, the coating surface quality is equal to or better than that achieved with a conventional HDG zinc layer according to EN ISO 1461 (i.e. with not more than 2% other metals in the zinc bath). Regarding corrosion resistance, the coating layers of this invention achieve about 1,000 hours in the salt spray test of ISO 9227 which is much better than the about 600 hours achieved with a conventional HDG zinc layer according to EN ISO 1461. Moreover, pure zinc galvanizing baths may also be used in the present invention.

Moreover the process of the present invention is well adapted to galvanize steel articles of any shape (flat, cylindrical, etc.) such as, but not limited to wires, sheets, tubes, rods, rebars and the like, being made from a large variety of steel grades, in particular, but not limited to, steel articles made from steel grades having a carbon content up to 0.30 wt. %, a phosphorous content between 0.005 and 0.1 wt. % and a silicon content between 0.0005 and 0.5 wt. %, as well as stainless steel. The classification of steel grades is well known to the skilled person, in particular through the Society of Automotive Engineers (SAE). In one embodiment of the present invention, the metal may be a chromium/nickel or chromium/nickel/molybdenum steel susceptible to corrosion. Optionally the steel grade may contain other elements such as, but not limited to, sulfur, aluminum, and copper. Suitable examples include, but are not limited to, the steel grades known as AISI 304 (*1.4301), AISI 304L (1.4307, 1.4306), AISI 316 (1.4401), AISI 316L (1.4404, 1.4435), AISI316Ti (1.4571), or AISI 904L (1.4539) [*1.xxxx=according to DIN 10027-2]. In another embodiment of the present invention, the metal may be a steel grade referenced as S235JR (according to EN 10025) or S460MC (according to EN 10149).

The following examples are given for understanding and illustrating the invention and should not be construed as limiting the scope of the invention, which is defined only by the appended claims.

Example 1—General Procedure for Galvanization at 440° C.

A plate (2 mm thick, 100 mm wide and 150 mm long) made from the steel grade S235JR (weight contents: 0.114% carbon, 0.025% silicon, 0.394% manganese, 0.012% phosphorus, 0.016% sulfur, 0.037% chromium, 0.045% nickel, 0.004% molybdenum, 0.041% aluminum and 0.040% copper) was pre-treated according the following pre-treatment sequential procedure:

- first alkaline degreasing by means of SOLVOPOL SOP (50 g/l) and a tenside mixture EMULGATOR SEP (10 g/l), both commercially available from Lutter Galvanotechnik GmbH, at 65° C. for 20 minutes;
- rinsing with water;
- first pickling in a hydrochloric acid based bath (composition: 10 wt % HCl, 12 wt % $FeCl_2$) at 25° C. for 1 hour;
- rinsing with water;
- second alkaline degreasing for 10 minutes in a degreasing bath with the same composition as in the first step above;
- rinsing with water;
- second pickling for 10 minutes in a pickling bath with the same composition as above;
- rinsing with water,
- fluxing the steel plate in a flux composition as described in one of the following tables, for 180 seconds at a concentration of 650 WI, and in the presence of 0.3% Netzer 4 (a non-ionic wetting agent commercially available from Lutter Galvanotechnik GmbH);
- drying at 100-150° C. for 200 seconds;
- galvanizing the fluxed steel plate for 3 minutes at 440° C. at a dipping speed of 1.4 m/minute in a zinc-based bath comprising 5.0% by weight aluminum, 1.0% by weight magnesium, trace amounts of silicon and lead, the balance being zinc; and
- cooling down the galvanized steel plate in air.

Examples 2 to 18—Steel Treatment with Illustrative Flux Compositions of this Invention Before Galvanizing at 440° C.

The experimental procedure of example 1 has been repeated with various flux compositions wherein the proportions of the various chloride components are as listed in table 1. The coating quality has been assessed by a team of three persons evaluating the percentage (expressed on a scale from 0 to 100) of the steel surface that is perfectly coated with the alloy, the value indicated in the last column of table 1 below being the average of these three individual notations. The coating quality has been assessed while keeping the fluxing bath either at 72° C. (examples 1 to 12, no asterisk) or at 80° C. (examples 13 to 18, marked with an asterisk).

TABLE 1

| Ex. | $ZnCl_2$ % | $NH_4Cl$ % | NaCl % | KCl % | $SnCl_2$ % | $PbCl_2$ % | Coating quality |
|---|---|---|---|---|---|---|---|
| 1 * | 59 | 20 | 3 | 12 | 4 | 1 | 75 |
| 2 | 60 | 20 | 3 | 12 | 4 | 1 | 90 |
| 3 * | 52.5 | 17.5 | 3 | 12 | 13 | 1 | 75 |
| 4 | 53 | 18 | 3 | 12 | 13 | 1 | 80 |
| 5 * | 52 | 21 | 4 | 17 | 4 | 1 | 70 |
| 6 | 52.5 | 21.5 | 4 | 17 | 4 | 1 | 60 |
| 7 | 60.5 | 12 | 4.5 | 18 | 4 | 1 | 60 |
| 8 | 57 | 19 | 3 | 12 | 8 | 1 | 85 |
| 9 | 59 | 20 | 4.5 | 11.5 | 4 | 1 | 70 |
| 10 | 59 | 20 | 2.5 | 13.5 | 4 | 1 | 70 |
| 11 | 60 | 20 | 12 | 3 | 4 | 1 | 50 |
| 12 | 60 | 20 | 7.5 | 7.5 | 4 | 1 | 50 |
| 13 | 61.3 | 20.4 | 3.1 | 12.3 | 2 | 1 | 95 * |
| 14 | 55 | 25 | 3 | 12 | 4 | 1 | 95 * |
| 15 | 56.1 | 25.5 | 3.1 | 12.2 | 2 | 1 | 90 * |
| 16 | 50 | 30 | 3 | 12 | 4 | 1 | 60 * |
| 17 | 54.1 | 18 | 12.6 | 10.8 | 3.6 | 0.9 | 70 * |
| 18 | 54.1 | 18 | 2.7 | 20.7 | 3.6 | 0.9 | 70 * |

* The flux compositions of examples 1,3 and 5 additionally contain 1 weight % NiCl2 to match up to 100% by weight.

Comparative Examples 19 to 22

The experimental procedure of example 1 has been repeated with flux compositions according to the prior art wherein the proportions of the various chloride components are as listed in table 2. The coating quality has been assessed by the same methodology as in the previous examples.

TABLE 2

| Ex. | $ZnCl_2$ % | $NH_4Cl$ % | NaCl % | KCl % | $SnCl_2$ % | $PbCl_2$ % | Coating quality |
|---|---|---|---|---|---|---|---|
| 19 | 78 | 7 | 4 | 8.5 | 0.5 | 1 | 5 |
| 20 | 60 | 21 | 3 | 12 | 4 | 0 | 20 |
| 21 | 53 | 22 | 4 | 17 | 4 | 0 | 20 |
| 22 | 52.1 | 31.3 | 3.1 | 12.5 | 0 | 1 | 20 |

The flux composition of example 19 additionally contains 1 weight % $NiCl_2$ to match up to 100% by weight.

These comparative examples demonstrate that when the flux composition contains no tin chloride, or no lead chloride, or when the sum of tin chloride and lead chloride is below 2.5 weight %, then the coating quality, as measured under the same conditions as for examples 1 to 18, is very poor.

Example 23—General Procedure for Galvanization at 520° C.

The sequential procedure of example 1 was repeated, the treatment step with a fluxing composition being performed at 80° C., except that in the penultimate step galvanizing was effected at 520° C. at a dipping speed of 4 m/minute in a zinc-based bath comprising 20.0% by weight aluminum, 1.0% by weight magnesium, trace amounts of silicon and lead, the balance being zinc.

Examples 24 to 31—Steel Treatment with Illustrative Flux Compositions of this Invention Before Galvanizing at 520° C.

The experimental procedure of example 23 has been repeated with various flux compositions wherein the proportions of the various chloride components are as listed in table 3 below. The coating quality has been assessed

TABLE 3

| Ex. | $ZnCl_2$ % | NH4Cl % | NaCl % | KCl % | $SnCl_2$ % | $PbCl_2$ % | Coating quality |
|---|---|---|---|---|---|---|---|
| 24 | 60 | 20 | 3 | 12 | 4 | 1 | 95 |
| 25 | 57 | 19 | 3 | 12 | 8 | 1 | 80 |
| 26 | 60 | 20 | 12 | 3 | 4 | 1 | 80 |
| 27 | 61.3 | 20.4 | 3.1 | 12.3 | 2 | 1 | 85 |
| 28 | 55 | 25 | 3 | 12 | 4 | 1 | 80 |
| 29 | 56.1 | 25.5 | 3.1 | 12.2 | 2 | 1 | 85 |
| 30 | 54.1 | 18 | 12.6 | 10.8 | 3.6 | 0.9 | 60 |
| 31 | 54.1 | 18 | 2.7 | 20.7 | 3.6 | 0.9 | 75 |

Example 32—General Procedure for Galvanization of Hardened Steel Plates

A 1.2 mm thick plate made from the hardened steel grade 22MnB5 (weight contents: 0.257% carbon, 0.27% silicon, 1.32% manganese, 0.013% phosphorus, 0.005% sulfur, 0.142% chromium, 0.018% nickel, 0.004% molybdenum, 0.031% aluminum, 0.009% copper and 0.004% boron) is treated according the following procedure:

blasting for 8 minutes with steel grits;

cleaning for 30 minutes in a commercially available cleaner from Henkel under the trade name Novaclean N (solution 10% weight with 2 g/l inhibitor Rodine A31);

rinsing with water;

fluxing the hardened steel plate at 80° C. in a flux composition as described herein for 180 seconds at a concentration of 650 g/l, and in the presence of 3 ml/l Netzer 4 (a non-ionic wetting agent from Lutter Galvanotechnik GmbH) and 10 ml/l of a corrosion inhibitor commercially available from Lutter Galvanotechnik GmbH under the reference PM. Specifically the flux composition comprises 59% by weight zinc chloride, 20% by weight ammonium chloride, 3% by weight sodium chloride, 12% by weight potassium chloride, 4% by weight tin chloride, 1% by weight lead chloride and 1% by weight nickel chloride;

drying at 100-150° C. for 120 seconds;

galvanizing the fluxed hardened steel plate for 3 minutes either at 440° C. at a dipping speed of 1.4 m/minute in a zinc-based bath comprising 5.0% by weight aluminum and 1.0% by weight magnesium, the balance being zinc, or at 520° C. in a zinc-based bath comprising 20.0% by weight aluminum and 2.0% by weight magnesium, the balance being zinc; and cooling down the galvanized hardened steel plate in air.

Example 33—General Procedure for Galvanization of Steel Wire

A wire (diameter 4.0 mm) from a steel grade with the following contents: 0.056% carbon, 0.179% silicon, 0.572% manganese, 0.011% phosphorus, 0.022% sulfur, 0.097% chromium, 0.074% nickel, 0.009% molybdenum, 0.004% aluminum and 0.187% copper) is treated according the following procedure:

first alkaline degreasing at 60° C. by means of SOLVOPOL SOP (50 g/l) and a tenside mixture Emulgator Staal (10 g/l), both commercially available from Lutter Galvanotechnik GmbH, for 10 seconds;

rinsing with water for 2 seconds;

pickling in a hydrochloric acid based bath (composition: 12 wt % HCl, 10 wt % $FeCl_2$, 1 wt % $FeCl_3$, 10 ml/l Emulgator DX from Lutter Galvanotechnik GmbH and 10 ml/l of inhibitor PM) at 50° C. for 10 seconds;

rinsing with water for 2 seconds;

fluxing the steel wire at 82° C. in a flux composition as described herein for 2 seconds (specifically the flux composition comprises 59% by weight zinc chloride, 20% by weight ammonium chloride, 3% by weight sodium chloride, 12% by weight potassium chloride, 4% by weight tin chloride, 1% by weight lead chloride and 1% by weight nickel chloride) and in the presence of 3 ml/l Netzer 4 (a wetting agent from Lutter Galvanotechnik GmbH);

drying until the wire surface temperature reaches 100° C.;

galvanizing the fluxed steel wire for 6 seconds either at 440° C. in a zinc-based bath comprising 5.0% by weight aluminum, 1.0% by weight magnesium, trace amounts of silicon and lead, the balance being zinc; or at 520° C. in a zinc-based bath comprising 20.0% by weight aluminum and 2.0% by weight magnesium, 0.12% Si, the balance being zinc, and cooling down the galvanized steel wire in air.

Example 34—Galvanization of Steel Plates at 510° C.

A steel plate (thickness 2.0 mm) from a steel grade S235JR (composition as defined in example 1) was treated according the following procedure:

first alkaline degreasing at 60° C. by means of SOLVOPOL SOP (50 WI) and a tenside mixture Emulgator Staal (10 g/l), both commercially available from Lutter Galvanotechnik GmbH, for 30 minutes;

rinsing with water;

first pickling in a hydrochloric acid based bath (composition: 12 wt % HCl, 15 wt % $FeCl_2$, 1 wt % $FeCl_3$, 2 ml/l of inhibitor HM and 2.5 ml/l Emulgator C75 from Lutter Galvanotechnik GmbH) at 25° C. for 60 minutes;

rinsing with water;

second alkaline degreasing bath at 60° C. by means of SOLVOPOL SOP (50 g/l) and a tenside mixture Emulgator Staal (10 g/l), both commercially available from Lutter Galvanotechnik GmbH, for 5 minutes;

rinsing with water;

second pickling in a hydrochloric acid based bath with the same composition as in the first pickling step at 25° C. for 5 minutes;

rinsing with water;

fluxing the steel plate at 80° C. for 3 minutes in a flux composition (comprising 60 wt. % zinc chloride, 20 wt. % ammonium chloride, 3 wt. % sodium chloride, 12 wt. % potassium chloride, 4 wt. % tin chloride and 1 wt. % lead chloride) with a total salt concentration of 750 g/l and in the presence of 1 ml/l Netzer 4 (a wetting agent from Lutter Galvanotechnik GmbH), by using an extraction speed of 4m/min or higher;

drying until the steel plate surface temperature reaches 120° C.;

galvanizing the fluxed steel plate for 3 minutes at 510° C. in a zinc-based bath comprising 20.0 wt. % aluminum, 4.0 wt. % magnesium, 0.2 wt. % silicon, trace amounts of lead, the balance being zinc; and cooling down the galvanized steel plate in air.

This procedure has been found to provide a superior coating quality similar to example 24. The following variants of this procedure also provide superior coating quality:

Idem but 650 g/l total salt concentration, 2 ml/l Netzer 4 in flux, and galvanizing in the zinc-based bath at 490° C., Idem but 650 g/l total salt concentration, 2 ml/l Netzer 4 in flux, and galvanizing in the zinc-based bath at 500° C. during 1 minute, Idem but 650 g/l total salt concentration, fluxing for 5 minutes with 2 ml/l Netzer 4 in flux, and galvanizing in the zinc-based bath at 510° C. during 10 minutes, Idem but 650 g/l total salt concentration, fluxing for 5 minutes with 2 ml/l Netzer 4 in flux, and galvanizing in the zinc-based bath at 530° C. during 5 minutes, and Idem but 650 g/l total salt concentration, fluxing for 5 minutes with 2 ml/l Netzer 4 in flux, and galvanizing in the zinc-based bath at 530° C. during 15 minutes.

Example 35—Galvanization of Steel Plates at 520° C.

A steel plate (thickness 2.0 mm) from a steel grade S235JR (composition as defined in example 1) was treated according the same procedure as in example 34, except for the following operating conditions:

in the fluxing step, a total salt concentration of 650 g/l in the presence of 2 ml/l Netzer 4, and a galvanizing step of 3 minutes at 520° C. in a zinc-based bath comprising 20.0 wt. % aluminum, 2.0 wt. % magnesium, 0.13 wt. % silicon, trace amounts of lead, the balance being zinc.

This procedure has been found to provide a superior coating quality similar to example 24.

The invention claimed is:

1. A flux composition for treating a metal surface to be coated in a hot dip galvanization process using a molten zinc-based galvanizing bath comprising:

from 4 wt. % to 24 wt. % aluminum, from 0.5 wt. % to 6 wt. % magnesium, and the rest being essentially zinc, wherein the flux composition comprises:

(a) more than 40 wt. % and less than 70 wt. % zinc chloride, (b) from 10 wt. % to 30 wt. % ammonium chloride, (c) more than 10 wt. % and less than 25 wt. % of a set of at least two alkali or alkaline earth metal halides, wherein the set of at least two alkali or alkaline earth metal halides is a set of at least two alkali metal chlorides, and wherein said set of at least two alkali metal chlorides comprises sodium chloride and potassium chloride in a KCl/NaCl weight ratio from 3.0 to 8.0;

(d) from 0.1 wt. % to 2 wt. % lead chloride, and (e) from 2 wt. % to 14 wt. % tin chloride, provided that the combined amounts of lead chloride and tin chloride represent at least 2.5 wt. % and at most 14 wt. % of said composition; and wherein the flux composition further comprises at least one of a non-ionic surfactant and a corrosion inhibitor.

2. A flux composition for treating a metal surface to be coated in a hot dip galvanization process using a molten zinc-based galvanizing bath comprising:

from 4 wt. % to 24 wt. % aluminum, from 0.5 wt. % to 6 wt. % magnesium, and the rest being essentially zinc, wherein the flux composition comprises:

(a) more than 40 wt. % and less than 70 wt. % zinc chloride, (b) from 10 wt. % to 30 wt. % ammonium chloride, (c) more than 10 wt. % and less than 25 wt. % of a set of at least two alkali or alkaline earth metal halides, wherein the set of at least two alkali or alkaline earth metal halides is a set of at least two alkali metal chlorides, and wherein said set of at least two alkali metal chlorides comprises sodium chloride and potassium chloride in a KCl/NaCl weight ratio from 3.0 to 8.0;

(d) from 0.1 wt. % to 2 wt. % lead chloride, and (e) from 2 wt. % to 14 wt. % tin chloride, provided that the combined amounts of lead chloride and tin chloride represent at least 2.5 wt. % and at most 14 wt. % of said composition; and wherein the flux composition further comprises at least one non-ionic surfactant.

3. A flux composition according to claim 2, wherein said set of at least two alkali metal chlorides includes sodium chloride and potassium chloride in a KCl/NaCl weight ratio from 3.5 to 8.0.

4. A flux composition according to claim 2, further comprising at least one metal chloride selected from the group consisting of nickel chloride, cobalt chloride, manganese chloride, cerium chloride and lanthanum chloride.

5. A flux composition according to claim 2, further comprising nickel chloride, wherein the nickel chloride is present in an amount up to 1.5 wt. % nickel chloride.

6. The flux composition according to claim 5, comprising 1 to 1.5 wt. % nickel chloride.

7. A flux composition according to claim 2, further comprising at least one corrosion inhibitor.

8. The flux composition according to claim 2, wherein the flux composition comprises from 18 wt. % to 30 wt. % ammonium chloride.

9. The flux composition according to claim 2, wherein said set of at least two alkali metal chlorides includes sodium chloride and potassium chloride in a KCl/NaCl weight ratio from 4.0 to 8.0.

10. The flux composition according to claim 9, wherein the flux composition comprises from 18 wt. % to 30 wt. % ammonium chloride.

11. The flux composition according to claim 2, further comprising water, wherein components (a)-(e) have a total concentration from 200 to 750 g/l.

12. The flux composition according to claim 2, wherein the flux composition is prepared by mixing the components (a) through (e) and the at least one non-ionic surfactant.

13. A fluxing bath comprising a flux composition according to claim 2 dissolved in water.

14. A fluxing bath according to claim 13, wherein the total concentration of components of the flux composition in water ranges from 200 to 750 g/l.

15. A process for the galvanization of a metal article, comprising a step of treating said article in a fluxing bath according to claim 13.

16. A galvanization process according to claim 15, wherein said metal article is an iron or steel article.

17. A galvanization process according to claim 15, wherein said treating step consists of immersing said article in said fluxing bath for a period of time from 0.01 to 30 minutes.

18. A galvanization process according to claim 15, wherein said treating step is performed at a temperature ranging from 50° C. to 90° C.

19. A galvanization process according to claim 15, wherein the treated article is further dried until its surface temperature ranges from 100° C. to 200° C.

20. A galvanization process according to claim 15, further comprising a step of dipping the treated article in a molten zinc-based galvanizing bath.

21. A galvanization process according to claim 20, wherein said molten zinc-based galvanizing bath comprises (a) from 4 to 24 wt. % aluminum, (b) from 0.5 to 6 wt. % magnesium, and (c) the rest being essentially zinc.

22. A galvanization process according to claim 21, wherein dipping is performed at a temperature ranging from 380° C. to 440° C. and wherein said molten zinc-based galvanizing bath comprises (a) 4 to 7 wt. % aluminum, (b) 0.5 to 3 wt. % magnesium, and (c) the rest being essentially zinc.

* * * * *